United States Patent [19]

Finkelstein

[11] 4,449,640

[45] May 22, 1984

[54] TAMPER-RESISTANT PHARMACEUTICAL VIAL AND CAP ASSEMBLY

[75] Inventor: Sam D. Finkelstein, Canton, Ohio

[73] Assignee: MPL, Inc., Canton, Ohio

[21] Appl. No.: 533,329

[22] Filed: Sep. 19, 1983

Related U.S. Application Data

[63] Continuation of Ser. No. 413,623, Sep. 1, 1982.

[51] Int. Cl.[3] ..... B65D 53/00

[52] U.S. Cl. ..... 220/270; 220/254; 220/306; 220/307; 220/375; 215/256

[58] Field of Search ..... 220/254, 270, 306, 307, 220/375; 215/256; 150/0.5

[56] References Cited

U.S. PATENT DOCUMENTS

| | | | |
|---|---|---|---|
| 3,737,066 | 6/1973 | Ames | 220/254 |
| 3,998,354 | 12/1976 | Song | 220/254 |
| 4,281,774 | 8/1981 | Mumford | 220/306 |

*Primary Examiner*—George T. Hall

*Attorney, Agent, or Firm*—McDermott, Will & Emery

[57] ABSTRACT

A pharmaceutical vial and cap assembly of the kind comprising an open-top vial covered by a cap with a depending peripheral skirt, the inner surface of the cap skirt and the outer surface of the vial having complementary mating interlock elements that preclude manual removal of the cap, the cap including an integral tear member, defined by one or more weakened junction lines, such that pulling away the tear member allows ready manual removal of the cap; the cap top includes a fill hole that for filling the vial with the cap in place, and the fill hole is closed, after filling, by a resilient stopper having a configuration effectively precluding manual removal, so that post-filling tampering and contamination are precluded. The stopper is preferably molded together with the cap, being connected to the cap by an integral strap.

10 Claims, 9 Drawing Figures

Fig. 1.
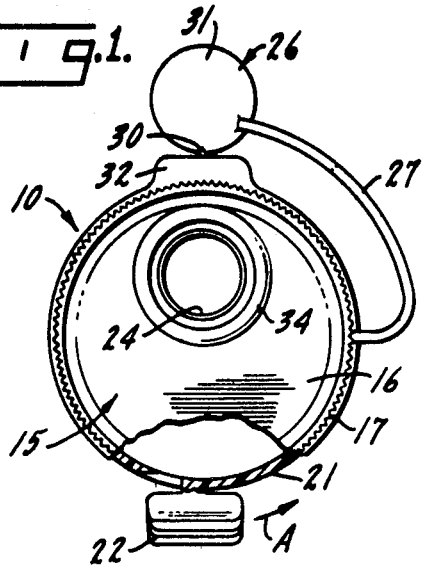
Fig. 2.
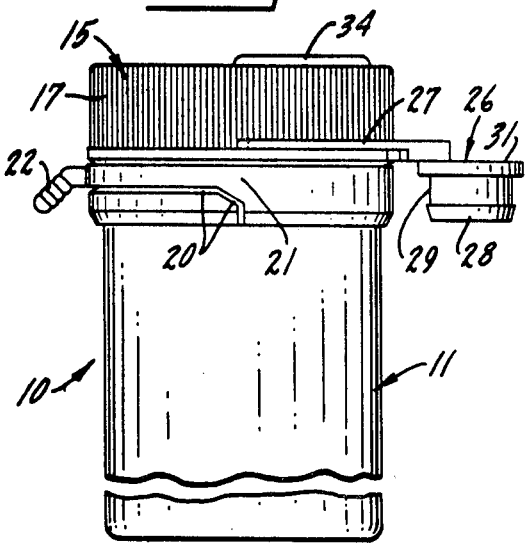
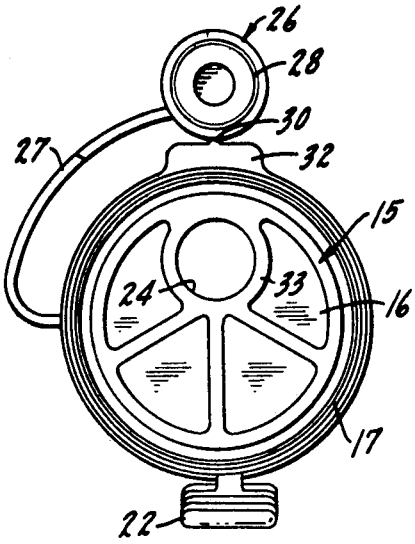
Fig. 3.
Fig. 4.
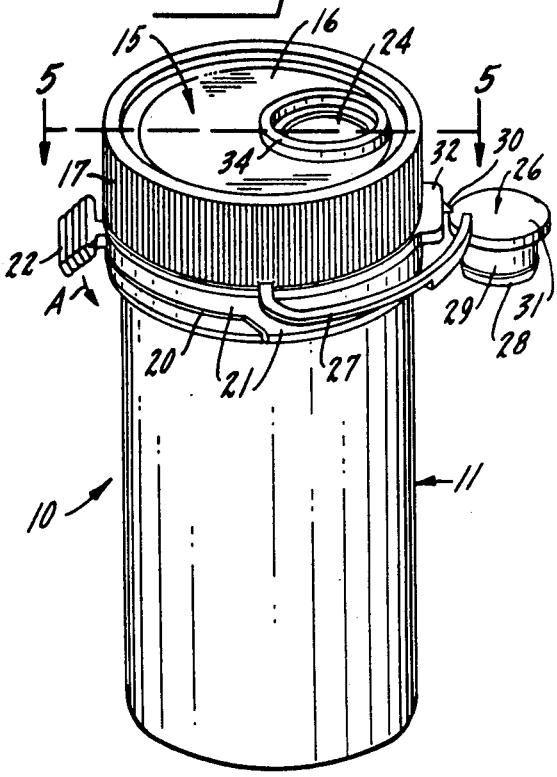

25
35
34
16
15
24
33
27
30
32
31
18
18
19
19
22
29
21
20
28
21
17
26
10
11
13
12
14

26
27
31
24
34
15
33
17
28
29

126
129
124
116
115
119
121
120
112
118
117
111

226
219
220
227
215
216
224
222
226
215
219
220
217
211
222

TAMPER-RESISTANT PHARMACEUTICAL VIAL AND CAP ASSEMBLY

This is a continuation of application Ser. No. 413,623, filed Sept. 1, 1982.

BACKGROUND OF THE INVENTION

In hospitals, clinics, and other health care facilities, a wide variety of medications and other pharmaceuticals are administered to patients by oral ingestion. Oral administration generally requires that a pharmaceutical dose be deposited in a vial in the pharmacy of the health care facility, from which it is transported to the patient and ultimately administered. This procedure provides many opportunities for contamination, spillage, or outright tampering, since efficient operation of the pharmacy makes it desirable to pre-fill a number of vials of a given medication at one time, though use may be spread out over an entire day or even several days. If the vials are sealed at the time of filling, the patient or the nurse may experience difficulty in opening a vial at the time of administration, depending upon the type and construction of seal employed. Contamination before, during and after filling is a persistent problem. Post-filling tampering, which may involve removal of part of the contents of a vial, dilution through addition to the contents of the vial, or even complete substitution, is often possible.

A number of different constructions are known for sealed vials. Most of these devices employ caps or closures of multi-part construction, involving a molded stopper of elastomer or resin material in conjunction with a clamping ring (usually metal) to hold the stopper in place. Additional elements, such as resin or metal covering discs, are commonly used in conjunction with the principal stopper and clamp ring. Access to the vial interior is frequently provided by a slit valve or other opening in the stopper. Devices of this kind are disclosed in Campbell U.S. Pat. No. 2,236,491, Breakstone U.S. Pat. No. 2,579,724, Roberts U.S. Pat. No. 2,797,837, Gould U.S. Pat. No. 3,013,687 Reimann U.S. Pat. No. 3,067,898, Hershberg et al U.S. Pat. No. 3,424,329, Wimmer U.S. Pat. No. 3,653,528, Westfall U.S. Pat. No. 3,690,499, Zackheim U.S. Pat. No. 3,823,840, and in Cantrill British Patent No. 602,763.

A unit dose vial used for oral administration of pharmaceuticals is described in Handman U.S. Pat. No. 4,244,478, issued Jan. 13, 1981; it provides an elastomer stopper which seals the vial and affords a rim covering the lip of the vial, together with a metal sealing ring crimped onto the vial and covering the stopper rim. The stopper has a self-venting self-sealing linear slit valve that allows filling of the vial with the stopper in place. The sealing ring includes an integral release tab permitting quick and convenient removal of both the ring and the stopper for oral administration of the vial itself.

Another container and closure assembly adaptable to unit dose vials is described in Miskin U.S. Pat. No. 3,595,420, issued July 27, 1971, in which an open-top vial is covered by a resilient molded cap that has an integral skirt encompassing the upper portion of the vial; the inner surface of the skirt and the outer surface of the vial have complementary mating interlock elements that preclude manual removal of the cap from the vial. The cap comprises a tear member defined by one or more weakened junction lines molded into the skirt. Removal of the tear member permits convenient removal of the cap from the vial at the time of administration.

These prior art devices commonly prevent contamination of the interior of the vial prior to and during filling. Frequently, the same devices also prevent casual contamination of the contents of the vial after filling. Indeed, this is true of most of the prior art devices noted above. The Miskin device, on the other hand, provides no protection for the vial before filling, but does prevent any post-filling tampering with the contents of the vial, whether by way of extraction from or addition to the vial.

Ideally, a vial intended for oral administration of pharmaceuticals should permit filling with the vial closure already in place to maintain the vial in clean and sterile condition. At the same time, the vial assembly should permit rapid and convenient removal of the vial cap, by either a nurse or a patient, for oral administration of the pharmaceutical. The vial and closure assembly also should prevent any casual contamination of the contents of the vial after it has been filled and should preclude tampering by addition to, removal from, or even complete substitution for the contents of the vial. These somewhat conflicting requirements have not been fully and effectively met in any single vial and closure assembly of the prior art.

SUMMARY OF THE INVENTION

It is an object of the present invention, therefore, to provide a new and improved vial and cap assembly suitable for use in unit dose oral administration of pharmaceuticals which maintains the vial effectively closed prior to filling, which permits rapid filling of the vial with the cap in place, and which effectively precludes both post-filling contamination and tampering.

Another object of the invention is to provide a new and improved tamper-resistant pharmaceutical vial and cap assembly that can be filled with the cap on the vial and that is simple and inexpensive in construction, with the entire closure for the vial constituting a unitary device of molded resilient material.

BRIEF DESCRIPTION OF THE DRAWINGS

FIG. 1 is a plan view, partially cut away of a tamper-resistant pharmaceutical vial and cap assembly constructed in accordance with a preferred embodiment of the present invention;

FIG. 2 is an elevation view of the vial and cap assembly of FIG. 1;

FIG. 3 is a bottom view of the cap of FIGS. 1 and 2;

FIG. 4 is a perspective view of the vial and cap assembly of FIGS. 1–3;

DESCRIPTION OF THE PREFERRED EMBODIMENTS

Figures 5, 6, 7, 8, 9:
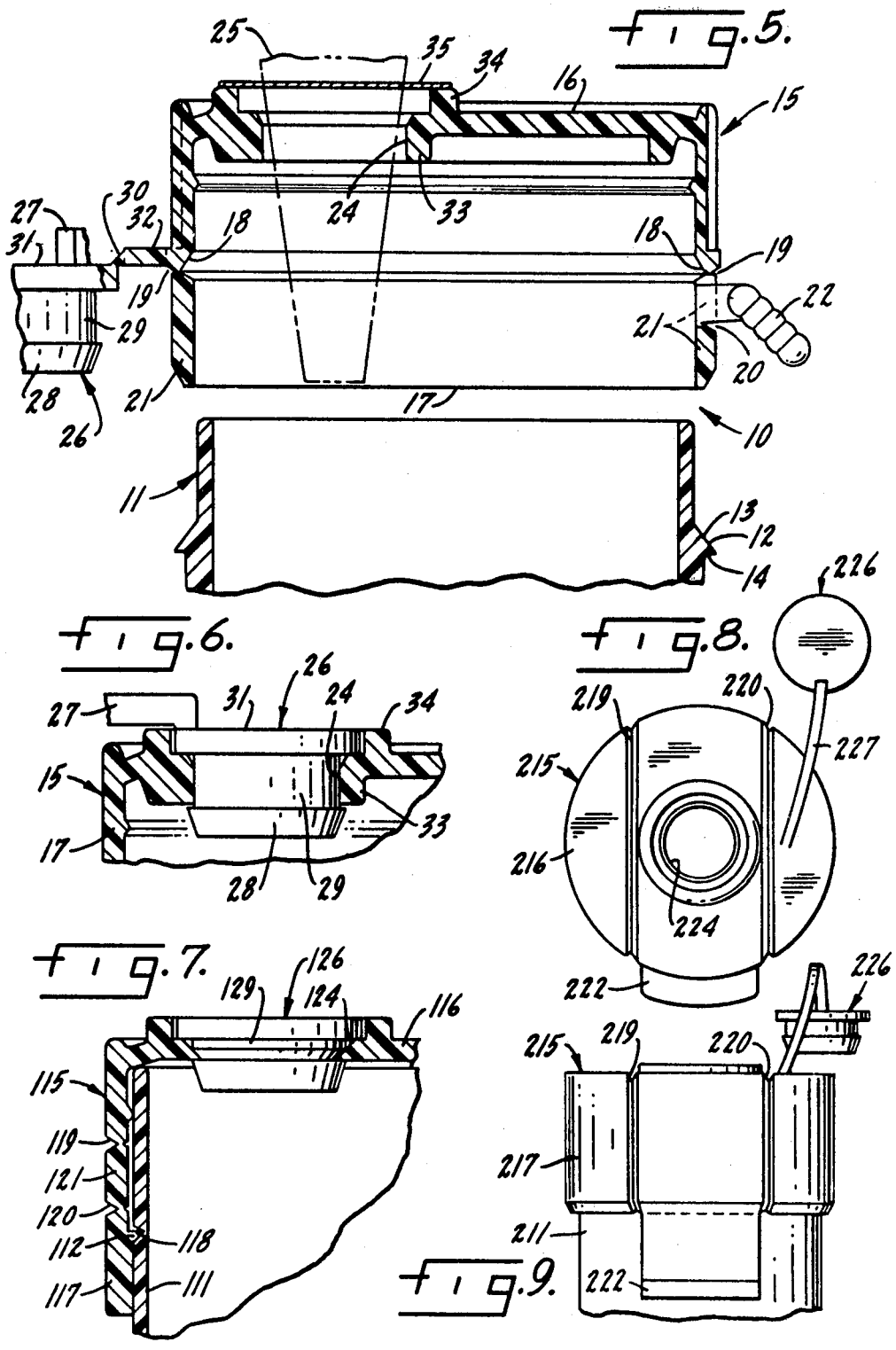
FIG. 5 is a sectional view, on an enlarged scale, taken approximately as indicated by line 5—5 in FIG. 4 but with the cap not yet positioned on the vial.
FIG. 6, is a detail sectional view illustrating use of a stopper that is part of the cap of FIGS. 1–4.
FIG. 7 is a detail sectional view, like FIG. 5, illustrating modifications in the cap and the stopper.
FIG. 8 is a plan view of and cap utilized in another embodiment of the invention.
FIG. 9 is an elevation view of a cap and vial assembly using the cap of FIG. 8.

FIGS. 1–5 illustrate a tamper-resistant unit dose pharmaceutical vial and cap assembly 10 for dispensation and oral administration of a predetermined dosage of a pharmaceutical preparation, constructed in accordance with a preferred embodiment of the present invention. Assembly 10 includes an open top vial 11, preferably formed of molded resin. Typically, vial 11 may be molded of USP amber polypropylene with an overall height of about 2.5 inches, a diameter of about one inch, and an internal capacity of the order of twenty to thirty milliliters. Vial 11 is of simple, open, cup-shaped configuration, but does include an external projection 12 extending circumferentially of the outer top portion of the vial as shown in FIG. 5. The external projection 12 on the vial has an angled upper face 13 and a horizontal lower face 14. Projection 12 may be continuous around the circumference of vial 11, or may comprise a series of spaced projections.

Assembly 10 further comprises a cap 15 of inverted generally cup-shaped configuration including a top 16 and a depending skirt 17 which fits over the top of vial 11. Cap 15 is of molded resilient material; polyethylene is preferred but other resins and elastomers may be employed. The cap may be opaque, in any desired color.

The inner surface of cap skirt 17 includes a V-shaped peripheral indentation 18 (FIG. 5) which extends around the entire circumference of the cap skirt. When cap 15 is mounted on vial 11, indentation 18 is engaged by the peripheral external projection 12 on vial 11. A weakened junction line 19 is formed in the external surface of cap skirt 17 immediately opposite the indentation 18 that receives the tip of vial projection 12. A second weakened junction line 20 in skirt 17 is located below line 18–19. Line 20 does not extend completely around skirt 17; it turns downwardly to the bottom of the skirt as shown in FIGS. 2 and 4.

The weakened junction lines 18–19 and 20 define a tear member 21 constituting a tear band extending circumferentially of cap 15. A pull tab 22 (FIGS. 1–5) is molded integrally with tear member 21 and projects outwardly therefrom.

As thus far described, vial 11 and cap 15 afford a container and closure assembly of the kind described in the aforementioned Miskin U.S. Pat. No. 3,595,420. Cap 15 is mounted on vial 11 by forcing the cap skirt 17 downwardly over the top of the vial until the projection 12 on the vial engages in the peripheral indentation 18 in the cap skirt. Projection 12 is of sufficient diameter to afford an interference fit with the lower portion of skirt 17 comprising tear strip 21. When mounted in place on vial 11, cap 15 cannot be manually removed from the vial without partial destruction of the cap.

To remove cap 15 from vial 11, tab 22 is grasped and pulled around vial 11 in the direction of arrow A, FIGS. 1 and 4. When this is done, the tear member 21 around the bottom of cap skirt 17 is effectively removed, the cap-vial interlock is destroyed, and the cap is free to be lifted from vial 11.

The improved construction of the present invention, which permits filling of vial 11 after cap 15 has been mounted on the vial but which nevertheless precludes post-filling contamination or tampering, comprises a fill hole 24 formed in the top 16 of cap 15. Fill hole 24 is quite small in relation to the surface area of cap top 16 but is made large enough to receive a conventional blunt fill needle as conventionally used in the filling of back-fill syringes and vials. Such a fill needle 25 is shown in phantom lines in FIG. 5. Fill hole 24 affords ready access to the interior of vial 11 so that the vial can be filled with cap 15 mounted on the vial. A fill hole diameter of 0.375 inch or less is preferred.

Cap 15 further includes a small stopper 26 molded as a part of cap 15 and connected to the cap skirt by an elongated integral flexible connector element 27. For example, connector element 27 may comprise a thin strap approximately 0.04 inch square. Stopper 26 includes a tapered lower portion 28, a peripheral slot 29, and an enlarged upper portion 31. Stopper 26 has a configuration that allows insertion into fill hole 24 but that effectively precludes manual removal from the fill hole after insertion, as described below. A very small frangible bridge connection 30 between stopper top 31 and a tab 32 on skirt 17 may be formed in molding cap 15; see FIGS. 1 and 3–5.

The manner in which vial 11 is filled with a predetermined dosage of a pharmaceutical preparation is generally illustrated in FIG. 5, assuming cap 15 has previously been mounted on vial 11. A fill needle 25 is inserted in the top 16 of cap 15, through fill hole 24. The fill needle is usually mounted on a fill tube (not shown), which may be connected to a dispensing syringe or to a dosage dispensing machine. The desired dose of the pharmaceutical is deposited in vial 11 in this manner, following which stopper 26 is inserted in fill hole 24 to close and seal the vial.

FIG. 6 shows stopper 26 mounted in place in fill hole 24 after filling of the vial. The tapered lower portion 28 of the stopper has been forced down through fill hole 24, the axial length of which is extended by a skirt 33 formed integrally with cap top 16. The top of the tapered portion 28 of stopper 26 is larger than the fill hole but the bottom of the tapered portion is smaller than the fill hole. With stopper 26 in place, fill hole 24 is closed and sealed both by the lower tapered portion 28 of the stopper and by the top cover portion 31 of the stopper. To assure an effective seal, the peripheral slot 29 in stopper 26 should be essentially equal in height to the thickness of the cap top 16 so that a tight, sealed fit is obtained. As will be apparent from FIG. 6, the configuration of stopper 26 effectively precludes manual removal of the stopper from fill hole 24. The tamper-resistant characteristics of stopper 26 are aided by an integral ring 34 molded in cap top 16 around the top of fill hole 24.

To prevent contamination of the interior of vial 11 prior to filling, it may be desirable to close fill hole 24 with a temporary closure member 35 as shown in FIG. 5. The temporary closure member 35 may, in its simplest form, comprise a short length of a strip of thin plastic film coated with an appropriate pressure sensitive adhesive on the surface that contacts the top 16, 34 of cap 15. Alternatively, the temporary closure member 35 may be formed as a thin molded plastic element, integral with cap 15, that can be readily broken by even the blunt fill needle 25. If an adhesively attached temporary closure member 35 is used, it is preferably removed before filling.

The vial and cap combination 10 shown in FIG. 1–6 and described above permits assembly of the complete device at the point of manufacture. Thus, assembly 10 can be shipped to the hospital or other pharmacy with cap 15 already mounted on vial 11. Of course, the assembly can be sterilized at the factory and, particularly with fill hole 24 covered by a temporary closure member 35, can be readily maintained in sterile condition until filled. Thus, there is little or no opportunity for contamination prior to filling of the vial.

Once vial 11 has been filled with the desired pharmaceutical dosage, stopper 26 is immediately mounted in fill hole 24, closing and sealing the top of the vial (FIG. 6). Stopper 26 effectively precludes casual contamination after filling; the filled vial can be stored for any desired length of time and is fully protected against contamination until actually used. Furthermore, after filling and insertion of stopper 26, tampering with the contents of the vial is prevented. Stopper 26, once mounted in place, resists manual removal so that there is no opportunity for adding anything to the contents of the vial or for removing any part of the vial contents, short of removal of cap 15.

At the time a pharmaceutial dosage in vial 11 is to be administered to a patient, either a nurse or a patient opens the vial simply by pulling on tab 22 to release the tear band 21. With the tear band effectively removed (it remains attached to the cap), cap 15 simply lifts off of vial 11 and oral administration proceeds unimpeded. There is little or no danger of re-use, since the pulling away of tear band 21 makes it obvious that the vial assembly has been used and should not be employed again.

FIG. 7 illustrates a modified construction for the cap of the assembly. Cap 115 includes a top 116 and a depending skirt 117 encompassing the upper portion of a vial 111. The cap skirt 117 includes a peripheral external projection 112 (continuous or interrupted) and vial 111 has a circumferential indentation 118 that fits over projection 112 and prevents manual removal of the cap. Thus, in this embodiment the cap-vial interlock is inverted as compared with FIGS. 1–5. In cap 115, there are two weakened junction lines 119 and 120 extending around the skirt and conjointly defining a tear band 121.

In cap 115, the fill hole 124 is also slightly different from the previously described construction. The walls of the fill hole are tapered downwardly. The peripheral slot 129 in stopper 126 may be tapered somewhat to provide a close fit with the walls of fill hole 124. Otherwise, stopper 126 is essentially similar to previously described stopper 26. In use, the construction shown in FIG. 7 is the same as that of the embodiment of FIGS. 1–6, so that the operational description need not be repeated.

FIGS. 8 and 9 illustrate a pharmaceutical vial and cap assembly 210 comprising another embodiment of the present invention. The vial 211 of assembly 210 may be the same in construction as previously described vial 11. The cap 215 of assembly 210 is generally similar to previously described cap 15 and mounts on vial 211 in the same manner, being provided with a skirt 217 having a construction essentially similar to that previously shown except that in this instance there is no circumferential weakened junction line and no circumferential tear member. However, the top 216 of cap 215 is provided with a small fill hole 224 as in the previously described construction. Furthermore, cap 215 includes an integral molded connector strap 227 and a stopper 226 essentially similar to the strap 27 and stopper 26 of the first described embodiment.

Cap 215 is molded with two weakened junction lines 219 and 220 which are spaced from each other and which extend upwardly across skirt 217 and across the top 216 of cap 215. A pull tab 222 is attached to the portion of skirt 217 between junction lines 219 and 220. In the illustrated construction, fill hole 224 is located between junction lines 219 and 220 but this is not essential; it could be located elsewhere on top 216.

The use of the vial and cap assembly 210 shown in FIGS. 8 and 9 is essentially similar to the previously described embodiments. The only difference is that when the filled and stoppered vial is to be used, tab 222 is pulled upwardly to remove the strip portion of the cap between junction lines 219 and 220, effectively allowing convenient manual removal of the cap from the vial.

I claim:

1. In a tamper-resistant pharmaceutical vial and cap assembly comprising an open-top vial for dispensation of a predetermined dosage of a pharmaceutical preparation and a molded cap of resilient material mounted on and covering the top of the vial, said vial and cap assembly comprising:

a fill hole in the top of the cap affording access to the interior of the vial for filling the vial with the cap mounted on the vial; and a stopper insertable in the fill hole to close and seal the fill hole after filling of the vial, the stopper having a configuration effectively precluding manual removal of the stopper from the fill hole after insertion therein.

2. A tamper-resistant pharmaceutical vial and cap assembly according to claim 1 in which the stopper is molded integrally with the cap and is connected to the cap by an integral molded connector element.

3. A tamper-resistant pharmaceutical vial and cap assembly according to claim 1 and further comprising temporary closure means for closing the fill hole prior to filling of the vial.

4. A tamper-resistant pharmaceutical vial and cap assembly according to claim 3 in which the temporary closure means comprises a thin, puncturable membrane molded integrally with the cap.

5. A tamper-resistant pharmaceutical vial and cap assembly according to claim 3 in which the top of the cap includes an integral ring encompassing the top of the fill hole to limit access to the stopper, when the stopper is mounted in the fill hole.

6. In a tamper-resistant pharmaceutical cap assembly mountable on an open-top vial for dispensation of a predetermined dosage of a pharmaceutical preparation, said cap assembly comprising:

a fill hole in the top of the cap affording access to the interior of the vial for filling the vial with the cap mounted on the vial; and a stopper insertable in the fill hole to close and seal the fill hole after filling of the vial, the stopper having a configuration effectively precluding manual removal of the stopper from the fill hole after insertion therein.

7. A tamper-resistant cap assembly according to claim 6 in which the stopper is molded integrally with the cap and is connected to the cap by an integral molded connector element.

8. A tamper-resistant cap assembly according to claim 6 and further comprising temporary closure means for closing the fill hole prior to filling of the vial.

9. A tamper-resistant cap assembly according to claim 8 in which the temporary closure means comprises a thin, puncturable membrane molded integrally with the cap.

10. A tamper-resistant cap assembly according to claim 6 in which the top of the cap includes an integral ring encompassing the top of the fill hole to limit access to the stopper, when the stopper is mounted in the fill hole.

* * * * *

UNITED STATES PATENT AND TRADEMARK OFFICE

CERTIFICATE OF CORRECTION

PATENT NO. : 4,449,640

DATED : May 22, 1984

INVENTOR(S) : Sam D. Finkelstein

It is certified that error appears in the above-identified patent and that said Letters Patent are hereby corrected as shown below:

On the title page,

After "Application Date", insert "The term of this patent subsequent to December 13, 2000 is disclaimed".

Signed and Sealed this

*Twentieth* Day of *November 1984*

[SEAL]

*Attest:*

GERALD J. MOSSINGHOFF

*Attesting Officer*

*Commissioner of Patents and Trademarks*